US006313759B1

(12) United States Patent
Musland-Sipper

(10) Patent No.: US 6,313,759 B1
(45) Date of Patent: Nov. 6, 2001

(54) SYSTEM AND METHOD OF COMMUNICATION BETWEEN AN AIRCRAFT AND A GROUND CONTROL STATION

(75) Inventor: Lori J. Musland-Sipper, Robins, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 09/526,596

(22) Filed: Mar. 16, 2000

(51) Int. Cl.[7] ..... G08B 21/00
(52) U.S. Cl. ..... 340/945; 701/14
(58) Field of Search ..... 340/945, 963, 340/990, 995, 988; 701/14, 3

(56) References Cited

U.S. PATENT DOCUMENTS 4,642,775 * 2/1987 Cline et al. ..... 364/443
6,020,831 * 2/2000 Nishida et al. ..... 340/945
6,043,756 * 3/2000 Bateman et al. ..... 340/945
6,043,757 * 3/2000 Patrick ..... 340/945
6,108,523 * 8/2000 Wright et al. ..... 701/14
6,160,497 * 12/2000 Clark ..... 340/945

* cited by examiner

*Primary Examiner*—John Tweel
(74) *Attorney, Agent, or Firm*—Nathan O. Jensen; Kyle Eppele

(57) ABSTRACT

A system for communicating between an aircraft and a ground control station. The system includes a communications module disposed onboard the aircraft and capable of electronically communicating with the ground control station. The communications module includes an input interface that permits an operator onboard the aircraft to view messages that are sent and received from the ground control station. The input interface has a plurality of display configurations for the viewing and entry of information. The input interface permits data relevant to a flight of the aircraft to be entered by the operator while viewing at least one of the plurality of display configurations.

16 Claims, 10 Drawing Sheets

SYSTEM AND METHOD OF COMMUNICATION BETWEEN AN AIRCRAFT AND A GROUND CONTROL STATION

FIELD OF THE INVENTION

The invention relates to avionics, and more particularly, to a system that assists in the communication between an aircraft and a ground control station.

BACKGROUND OF THE INVENTION

Most airports have an air traffic control (ATC) center to coordinate the take-offs, landings, and the general airplane traffic around the airport. Pilots speak via radio to the ATC center to request permission or to receive instructions therefrom. However, as more and more aircraft crowd the skies it is becoming difficult for ATC centers to process the oral communications from so many aircraft.

Another difficulty is that pilots and air traffic controllers may not speak the same language. In such a situation it is difficult for important information to be communicated therebetween. Even if the pilots and air traffic controllers speak the same language, a misunderstanding of instructions or flight identification information may result in an unsafe flying condition. For example, a pilot flying an aircraft having the flight identifier AAL1234 may respond to ATC instructions for flight ALL1234 because the flight identifiers sound very similar.

Still another difficulty is that each ATC center typically broadcasts communications on a single radio frequency. Consequently, pilots listening to that frequency must hear every communication between the ATC center and every other airplane communicating therewith. It may be difficult for the pilot to filter out information pertaining to his or her airplane from the constant stream of irrelevant messages.

It is an object of the invention to provide an alternative to oral communication between an aircraft and an ATC center so that routine requests and instructions are not given via voice.

It is another object of the invention to provide a method of communication between an aircraft and an ATC center that enables an ATC center to manage a large number of aircraft simultaneously.

It is another object of the invention to provide a method of communication between an aircraft and an ATC center that is not unduly burdensome on a pilot, yet ensures that the pilot is made aware of essential air traffic information.

It is a further object of the invention to provide a method of communication that incorporates standard ATC nomenclature therein so that the method can be easily adopted by the aircraft industry with a minimum of training.

SUMMARY OF THE INVENTION

The invention accomplishes the above objects by providing a system for communicating between an aircraft and a ground control station. The system includes a communications module disposed onboard the aircraft and capable of electronically communicating with the ground control station. The communications module includes an input interface that permits an operator onboard the aircraft to view messages that are sent and received from the ground control station. The input interface has a plurality of display configurations for the viewing and entry of information. The input interface permits data relevant to a flight of the aircraft to be entered by the operator while viewing at least one of the plurality of display configurations.

The invention further provides a method for communicating between an aircraft and a ground control station. A communications module is provided onboard the aircraft. The module electronically communicates with the ground control station and includes an input interface that permits an operator to interact with the module and communicate with the ground control station. Messages that are sent and received from the ground control station are displayed on a portion of the input interface such that an operator may view the messages upon one of a plurality of display configurations. Data relevant to a flight of the aircraft is processed, the data having been entered by the operator while viewing at least one of the display configurations.

DETAILED DESCRIPTION OF THE DRAWINGS AND BEST MODE OF CARRYING OUT THE INVENTION

Figure 1:
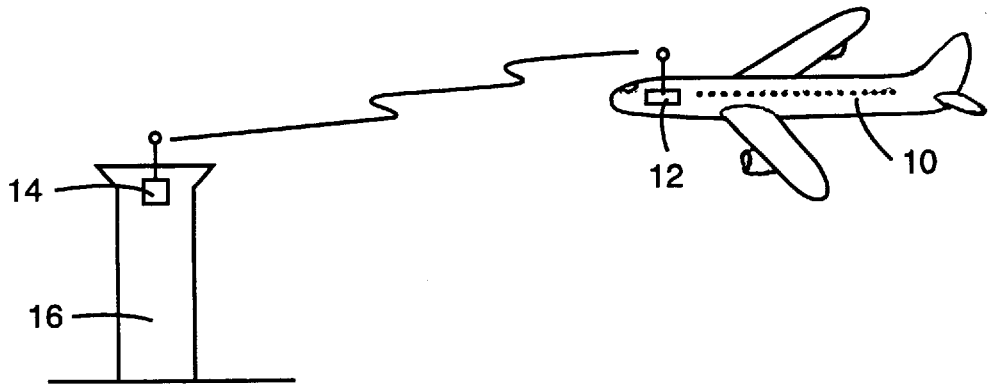
FIG. 1 is a perspective view of an airplane in communication with a ground control station.

FIG. 1 depicts an airplane 10 with a communications module 12 disposed therein. The communications module 12 sends and receives messages to and from a ground control station 14, which may be part of an ATC center 16. Aircraft 10 may communicate with a single ATC center during a flight, but typically will communicate with a plurality of ATC centers as the flight progresses.

Figure 2:
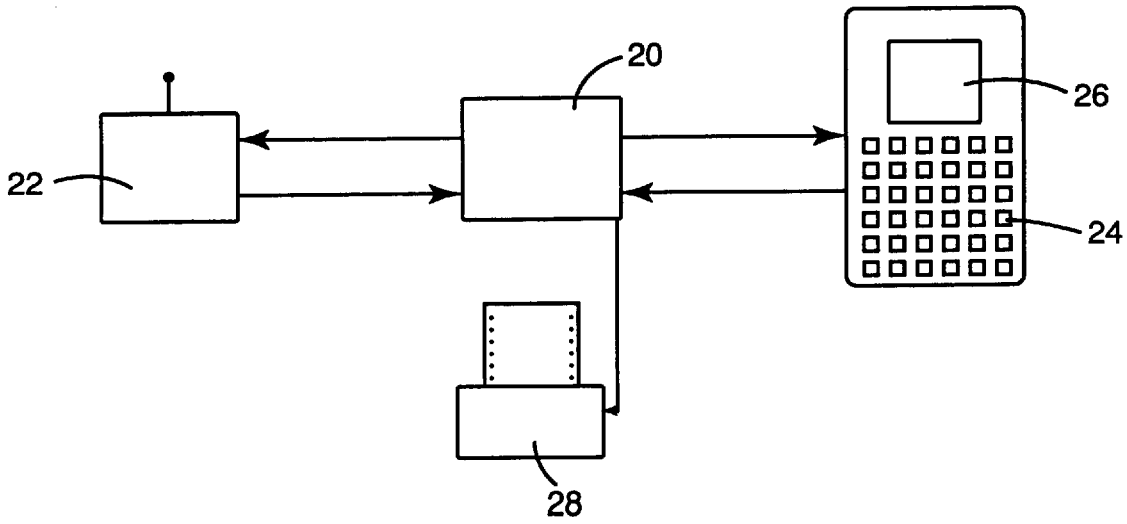
FIG. 2 is a schematic diagram of a communications module that may be installed in an airplane.

As shown in FIG. 2, communications module 12 includes a processor 20, which may include Read-Only and Random Access memory as well as data processing capability. A transceiver 22 is connected to processor 20 and permits the processor to communicate with ground control station 16. An input interface 24 permits an operator onboard airplane 10 to input data to the processor, and a display 26 permits communications module 12 to visually prompt and notify the operator of relevant data. A printer 28 is connected to the processor and permits the operator to selectively print copies of messages and data. Components of communications module 12 may be combined into a single unit or may be interconnected but separate elements within the module.

A data-link program is loaded onto processor. The program, which in one embodiment is called a Controller-Pilot Data Link Communication (CPDLC) program, enables the operator to communicate electronically with ground control station 16 by guiding the operator through a series of screen configurations or displays that either elicit flight information from the operator or notify the operator regarding flight information. The CPDLC program may be part of a larger flight information/control program or may serve as a stand-alone program.

Figure 3:
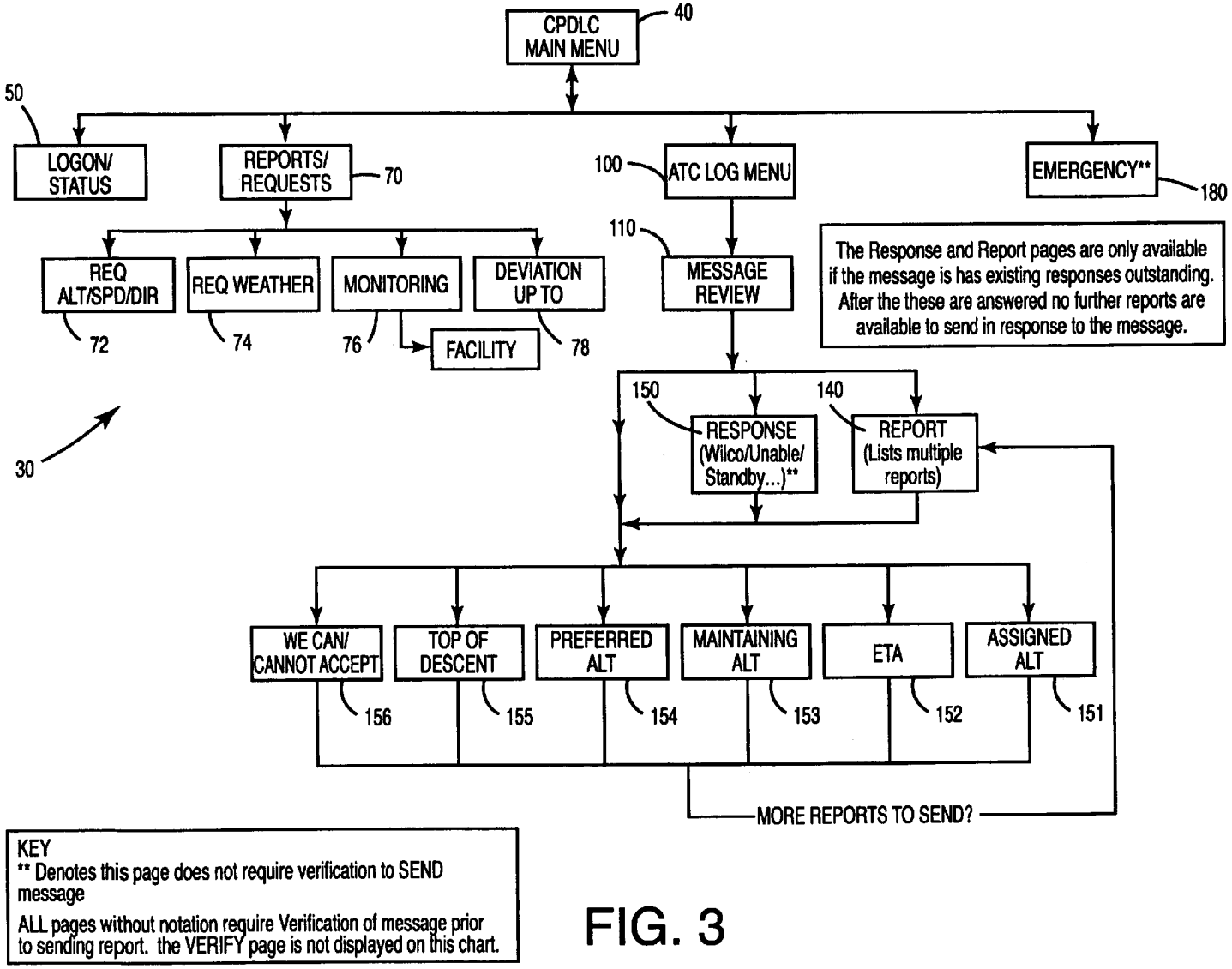
FIG. 3 is a flowchart of a computer program that is used to control communication between an airplane and a ground control station.
Figure 4:
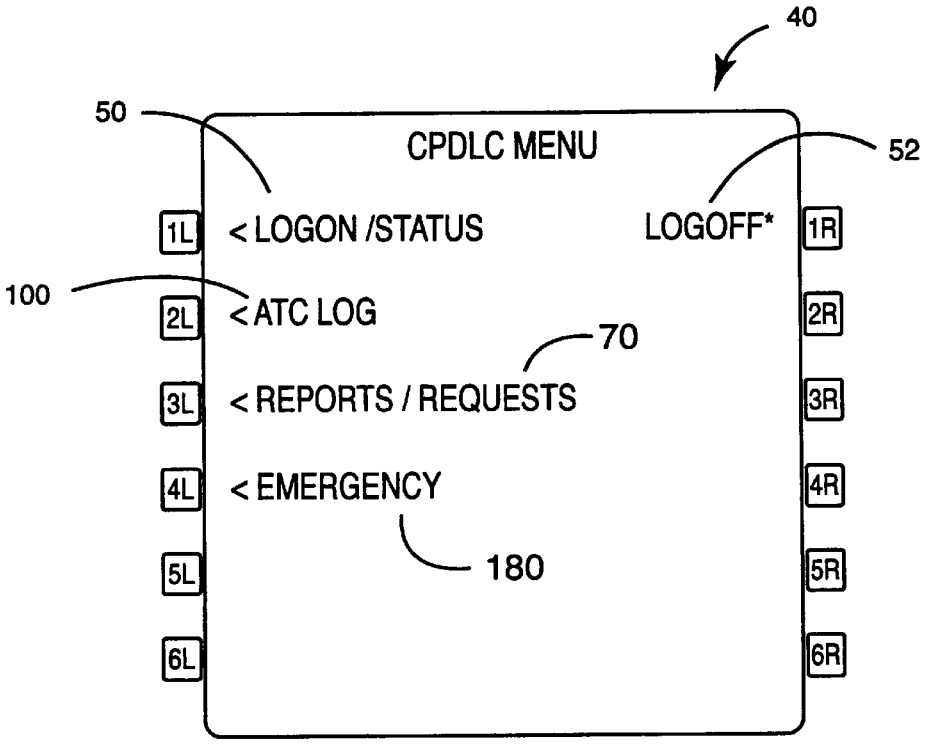
FIG. 4 is a view of an output display according to an aspect of the computer program of FIG. 3.

FIG. 3 is a schematic diagram of a menu tree 30 that shows how the CPDLC program is structured according to an embodiment of the invention. Menu tree 30 shows how the different screen displays may be accessed by a user. Upon logging onto the program, the main menu 40 is displayed (FIG. 4). It can be seen that the LOGON/STATUS menu 50, ATC LOG menu 100, REPORTS/REQUESTS menu 70, and the EMERGENCY menu 180 may all be accessed through main menu 40 by actuating or selecting buttons 1L, 2L, 3L or 4L, respectively. The buttons may be physical switches or software-created "soft" buttons that are actuated by locating a pointing icon (controlled by a mouse, trackball or the like) at or adjacent the soft button. The user may also log off by actuating button 1R, adjacent which is displayed LOGOFF at 52. Selection of LOGOFF causes the program to terminate any connection or communication with the ground. The program will not be enabled for the duration of the flight unless the user goes through LOGON/STATUS menu 50 and requests a logon with a desired ground control station. The program can be designed such that attempts by the ground to connect with the program will be denied until a logon request is sent from menu 50.

One feature of the invention is the use of a common display format. Buttons 1L through 6L and buttons 1R through 6R are provided in every menu to provide a familiar format for a user to interact with the program. Legends or options, which typically differ from menu to menu, are displayed adjacent the buttons. The legends or options represent pages or menus that are displayed when a corresponding button is actuated. As shown in main menu 40, not all buttons may have legends or options associated therewith; however, the constant display format ensures that a user does not become confused by different screen displays.

Figure 5:
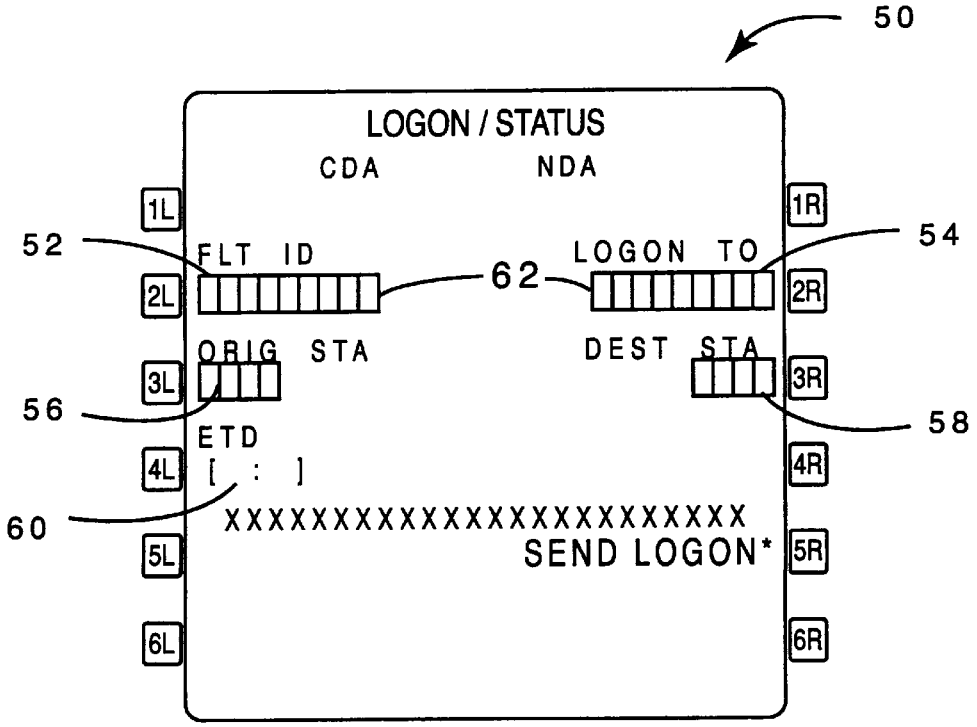
FIG. 5 is a view of an output display according to an aspect of the computer program of FIG. 3.

When button 1L is actuated while main menu 40 is displayed, LOGON/STATUS menu 50 is then displayed, as shown in FIG. 5. LOGON/STATUS menu 50 allows a user to enter information required to establish communication with a ground control station. During a logon process, menu 50 includes data fields to input flight identification 52, data authority identification 54, origination station 56, destination station 58, and optional estimated time of departure data 60. A user actuates the button adjacent each data field 52, 54, 56, 58 and 60 to enter the requested information. The program may be designed to require certain data in order to process the logon. Such required data fields are indicated in menu 50 by rectangular boxes 62 located where the data is to be provided. When all required data has been entered into the respective required data fields, the user actuates button 5R, which sends a logon request to the ground station.

Figure 6:
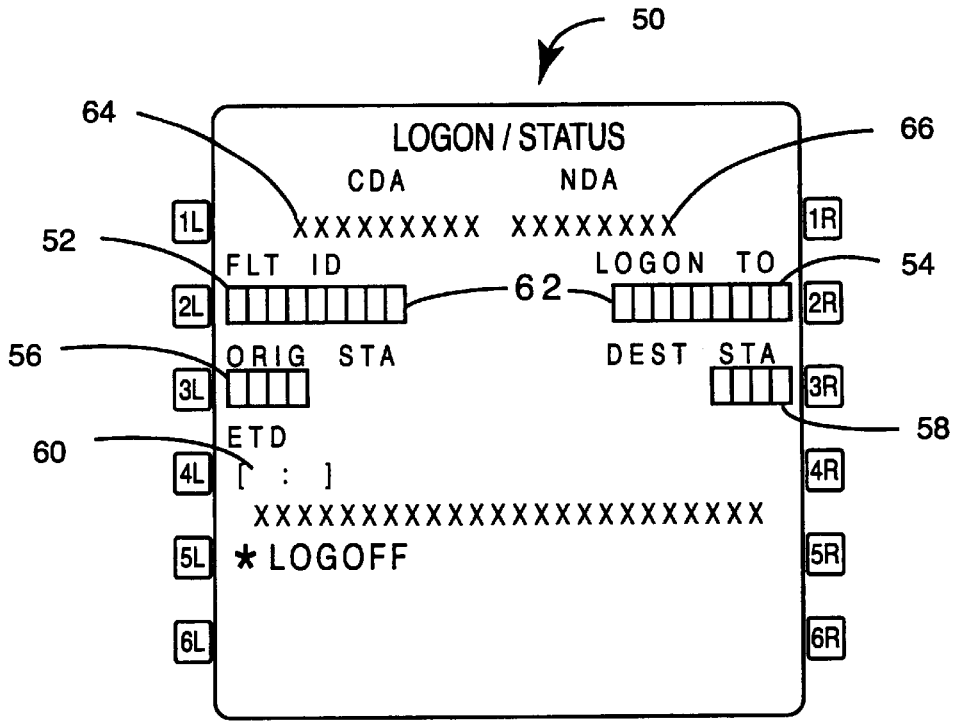
FIG. 6 is a view of an output display according to an aspect of the computer program of FIG. 3.

FIG. 6 shows the LOGON/STATUS menu once a connection with a ground control station has been established. In addition to data fields 52, 54, 56, 58 and 60, menu 50 displays the Current Data Authority (CDA) 64 and the Next Data authority (NDA) 66. This information is displayed so that the operator is aware of any automatic transfers of communication, which occurs when a new ATC center has been assigned to airplane 10 by the invention due to a change in position of the airplane. Actuating button 5L sends a logoff signal, which as described above terminates the communication session with the ground station.

Figure 7:
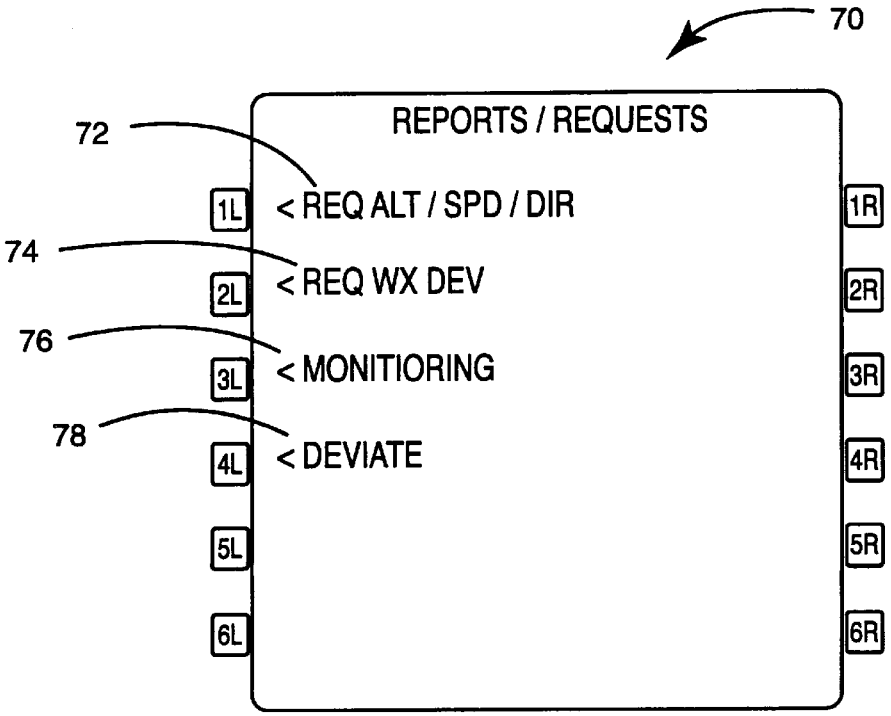
FIG. 7 is a view of an output display according to an aspect of the computer program of FIG. 3.

FIG. 7 depicts the REPORTS/REQUESTS menu 70, which is accessible from main menu 40. By actuating appropriate buttons 1L through 4L, the user is directed to one of several input pages. For instance, actuating button 1L brings up the REQ ALT/SPD/DIR page 72, which allows the operator to request to fly at a specified altitude or speed, or request to track from the present position directly to a specified position; actuating button 2L brings up the REQ WEATHER DEV page 74, which allows the operator to request for a weather deviation up to a specified distance and in a given direction; actuating button 3L brings up the MONITORING page 76, which allows the operator to send a message notifying the ground station that the operator is monitoring a specified ICAO unit on a specified frequency; and actuating button 4L brings up the DEVIATE page 78. Although not shown on menu 70, actuating button 6L returns the operator to main menu 40. Other requests or reports may also be included in this menu.

Figure 8:
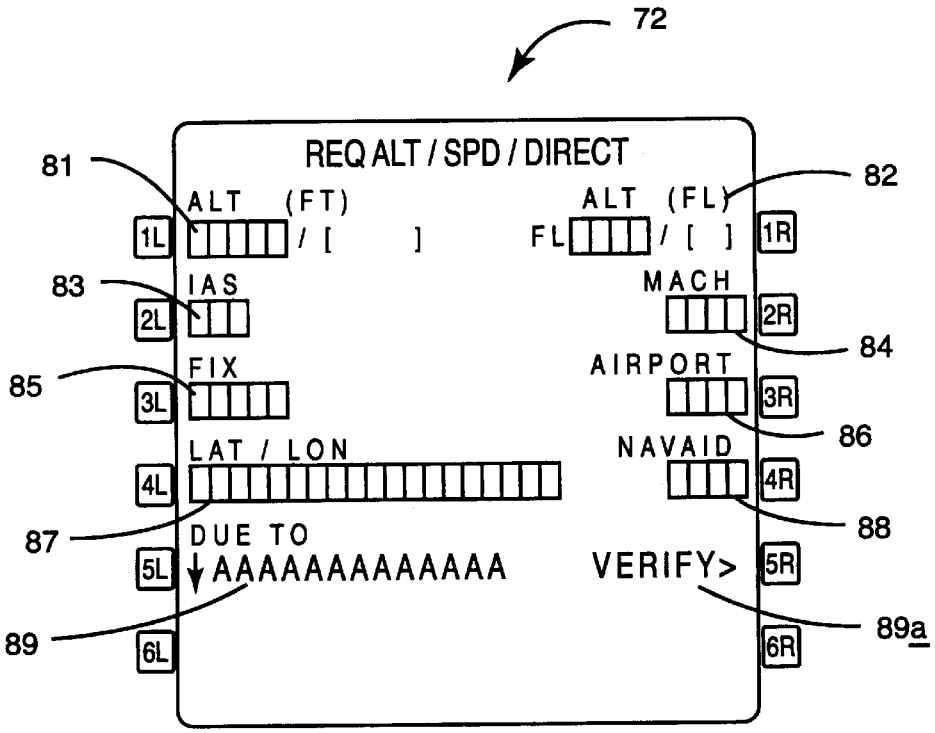
FIG. 8 is a view of an output display according to an aspect of the computer program of FIG. 3.

Each of the above-named input pages 72, 74, 76 and 78 permits a user to send data to a ground control center. In some instances, commonly used downlink/uplink commands may be communicated between the ground control center and the aircraft. For instance, as shown in FIG. 8, the REQ ALT/SPD/DIR page 72 allows the operator to input altitude expressed in feet 81, altitude expressed in flight level feet 82, Indicated air speed 83, mach number 84, fix 85, airport ID 86, latitude/longitude 87, navigation aid 88, and reasons for the request 89. Not all fields need to be entered; for example, an operator is required to enter altitude either in feet 81 or in flight level feet 82. Likewise, either indicated air speed 83 or mach number 84 need be entered. More than one set of information (altitude, speed, location, reason for refusal) may therefore be combined or concatenated into a single message to be downlinked to the ground control center. This configuration eliminates several data entry steps and therefore reduces the time required for an operator to use the system. Other input pages 74, 76 and 78 include spaces for the operator to input data relevant to the respective input page.

Figure 9:
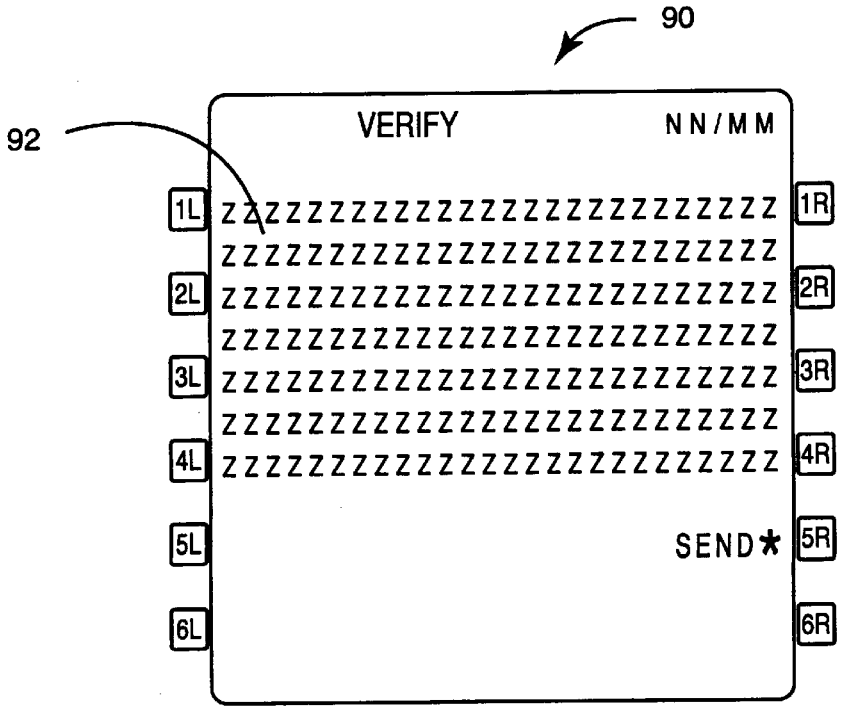
FIG. 9 is a view of an output display according to an aspect of the computer program of FIG. 3.

Once data is entered into the desired fields, a Verify prompt 89*a* is enabled and made visible adjacent button 5R. In a preferred embodiment, Verify prompt 89*a* is enabled only when the operator enters the minimum amount of information required to enable a downlink. A VERIFY screen is displayed, as depicted at 90 in FIG. 9, which permits the operator to confirm the message to be sent, which is displayed at 92. When the operator is satisfied with the message, the operator actuates button 5R, which causes the verified message to be sent to the ground control station.

Figure 10:
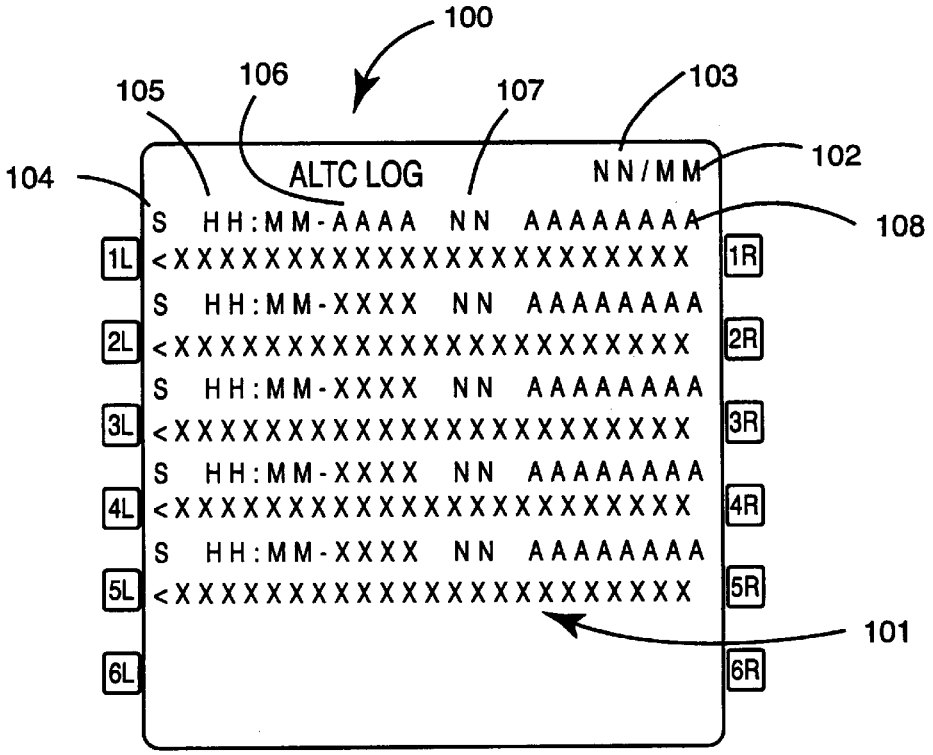
FIG. 10 is a view of an output display according to an aspect of the computer program of FIG. 3.

ATC LOG menu 100 (FIG. 10), accessible from main menu 40, permits the operator to review uplinks and downlinks that have been sent or received during the current flight leg. Each message is displayed on menu 100 at 101 and may be arranged in order of urgency and/or by timeliness (i.e., sorted from newest to oldest, or by other time based measures). The list of messages may also be displayed such that messages that have not been responded to are displayed at the beginning of the message list. If there are more messages than what can be accommodated on a single screen, the messages may be arranged on a plurality of pages. To simplify navigating such a plurality of pages, the total number of pages is displayed at 102 and the current page is displayed at 103. If message 101 is too long to be displayed on a single line, only a given number of characters of the message may be displayed.

With each message 101 is included an amount of descriptive information that enables the operator to ascertain the importance and status of the message. For example, an indicator 104 shows whether the message is an uplink or a downlink. The time the message was sent is shown at 105. The data authority (i.e., from where or to where the message was sent) is shown at 106. A message identification number, which is a unique number for each message and is supplied by the program, is displayed at 107. The status of the message is displayed at 108. The status of a message may be, but is not limited to, any of the indicators shown in Table 1 below.

TABLE 1

| Possible Status Responses for Messages | |
|---|---|
| | Description |
| Uplink | |
| NEW | A pending uplink message that has not been viewed. |
| OPEN | A pending uplink message that has been viewed, but to which no direct response has been sent. Note: Messages responded with STANDBY remain in this state. If the uplink does not require a response and no additional reports are required to close out the message, the status will immediately become CLOSED. |
| ACCEPTED | An uplink message that has been responded to with a WILCO, ROGER, AFFIRM, or a specific response other than WE CANNOT ACCEPT. |
| REJECTED | An uplink message that has been responded to with either an UNABLE, NEGATIVE, or WE CANNOT ACCEPT. This message is no longer pending and is considered closed. |
| CLOSED | A uplink message that has had all elements of the message responded to. Alternately, a message that does not require a response. |
| ERROR | A valid uplink message that caused an Error message to be generated from the Air. For example, the message timed out before the user could respond to the message. Note: Invalid uplink messages received will be discarded and not displayed to the user. |
| FAILED | An uplink message was pending when all connections were terminated. |
| Downlink | |
| PENDING | A downlink message that has not been responded to by the ground ATC facility (No Logical Acknowledgement (LACK)) Or, if no LACK is required the message is immediately placed at OPEN. |
| OPEN | A pending downlink for which a LACK has been received from the ground (if required) but no direct response to the message has been received. |
| CLOSED | A downlink message that may or may not have been viewed; And, has either been responded to by the ground ATC facility; Or for which no such response is required. |
| ERROR | A downlink message that caused an Error message to be generated from the ground. |

TABLE 1-continued

| Possible Status Responses for Messages | |
|---|---|
| | Description |
| FAILED | A downlink message that was open or pending and awaiting response when all connections were terminated. |

Figure 11:
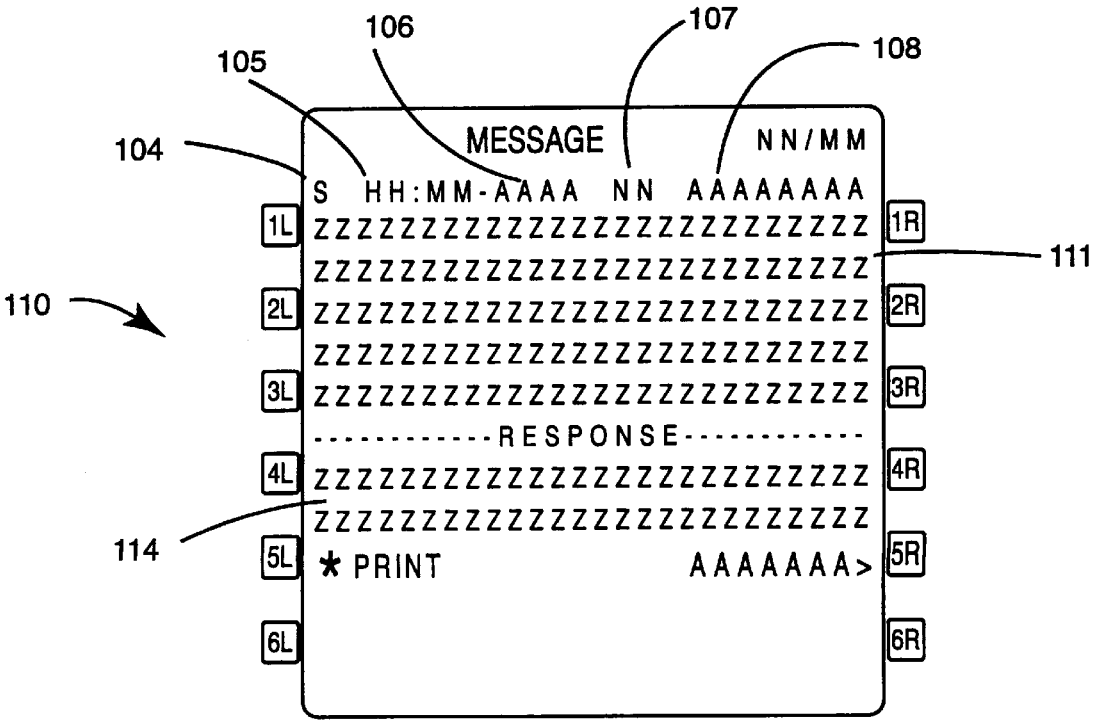
FIG. 11 is a view of an output display according to an aspect of the computer program of FIG. 3.

If the operator desires to see the complete message and response, the operator actuates one of buttons 1L–5L that is adjacent the desired message. Such actuation brings up a message review page 110, as shown in FIG. 11. The message review page may also be automatically displayed when a new message from a ground control station is detected, or when a response to a downlink is sent to the ground control station. The message review page includes the full text of a message at 111 along with the descriptive information shown in FIG. 10, i.e., uplink/downlink indicator 104, transmittal time 105, data authority 106, message identification number 107, and status 108. If the full text of the message is too long to fit into the space at 111, the remainder of the message may be shown by scrolling through the message.

Figure 12:
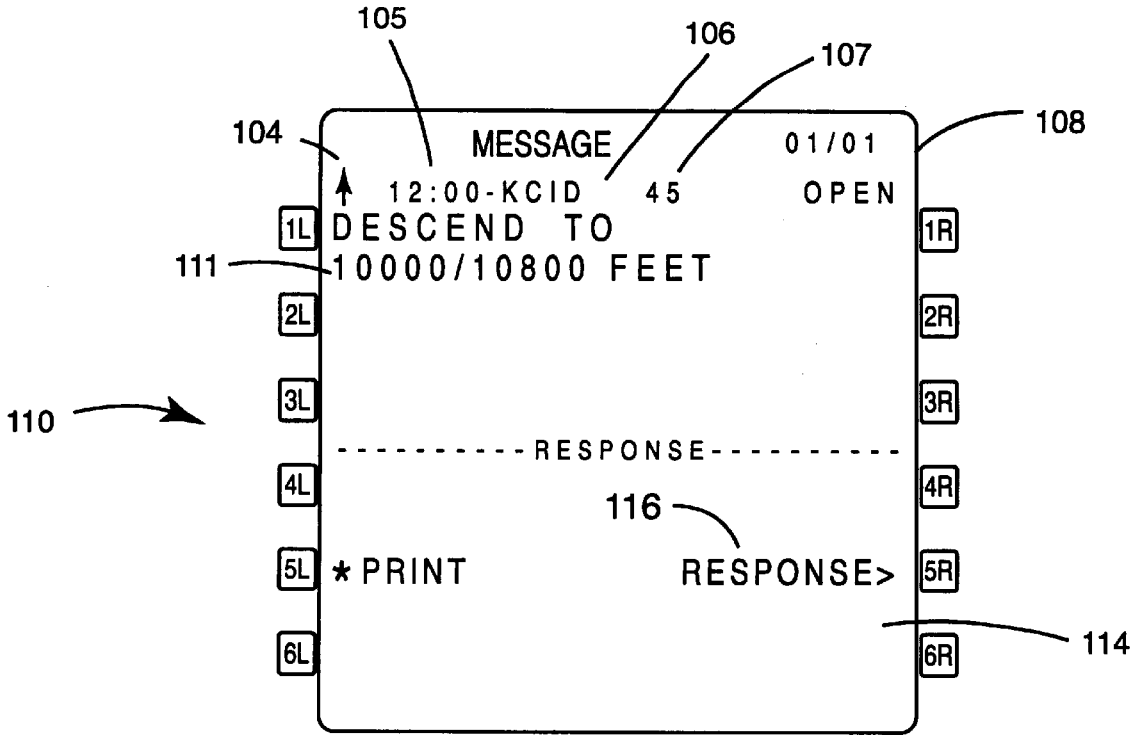
FIG. 12 is a view of an output display according to an aspect of the computer program of FIG. 3.
Figure 13:
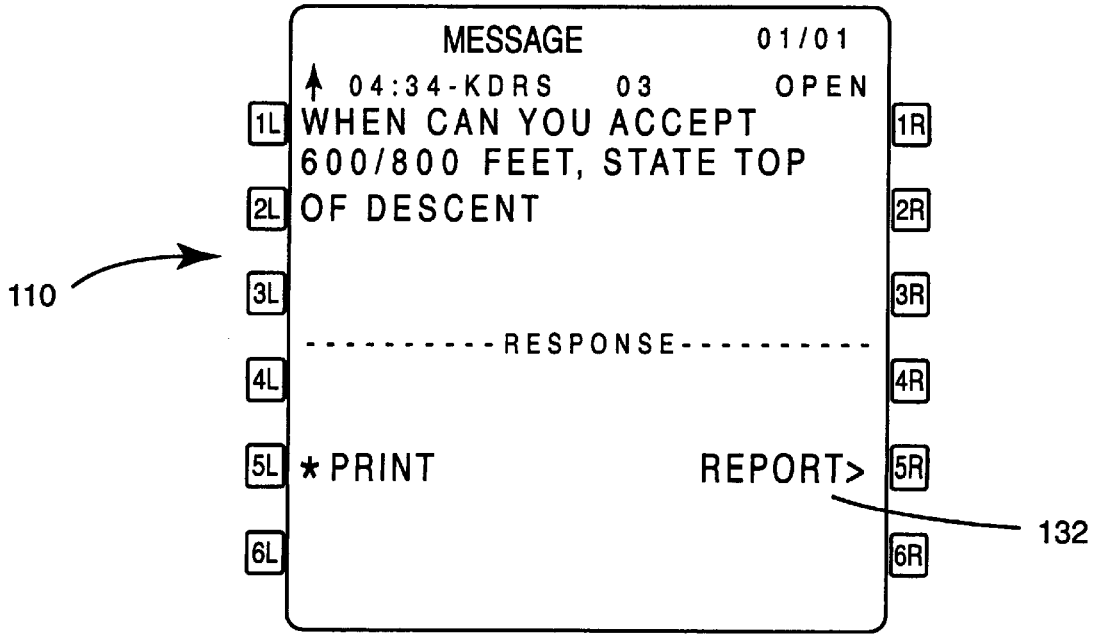
FIG. 13 is a view of an output display according to an aspect of the computer program of FIG. 3.
Figure 14:
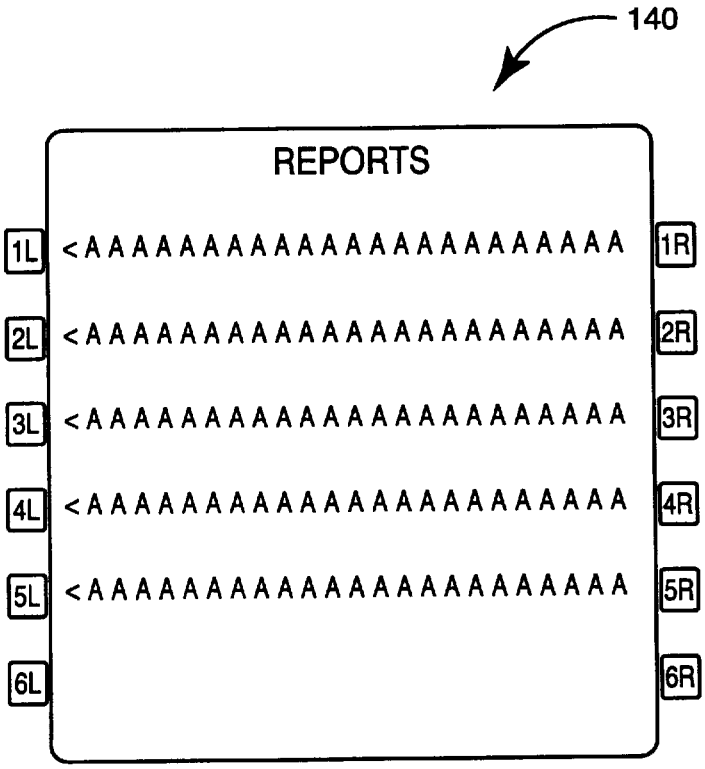
FIG. 14 is a view of an output display according to an aspect of the computer program of FIG. 3.
Figure 15:
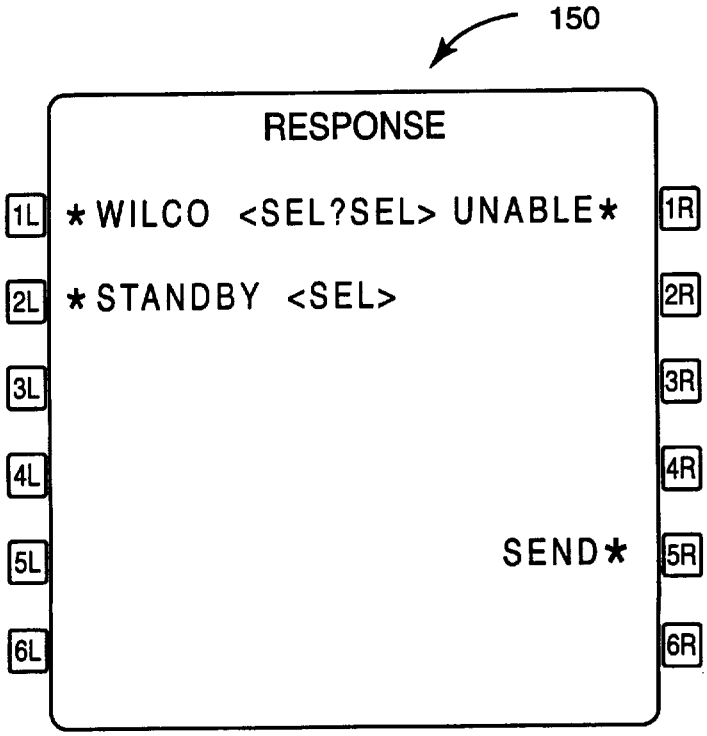
FIG. 15 is a view of an output display according to an aspect of the computer program of FIG. 3.

The lower portion 114 of the message review page is reserved to display the response or proposed response to the message. If a simple response is all that is required (such as ROGER, WILCO, UNABLE, and STANDBY), the proposed responses are displayed in lower portion 114. Alternately, the operator may be prompted at 116 (FIG. 12) to go to a separate RESPONSE page 150, as shown in FIG. 15, where the proposed responses are displayed. If multiple messages can be or are required to adequately respond to the message, the operator is prompted at 132 (FIG. 13) to access the REPORTS page 140 (FIG. 14). The REPORTS page is only available when there is more than one possible or required downlink to a pending uplink. Once a message has been responded to, lower portion 114 of message review page 110 displays the response. The "split-screen" message review page permits the operator to simultaneously review a message and the corresponding response or proposed response.

Figure 16:
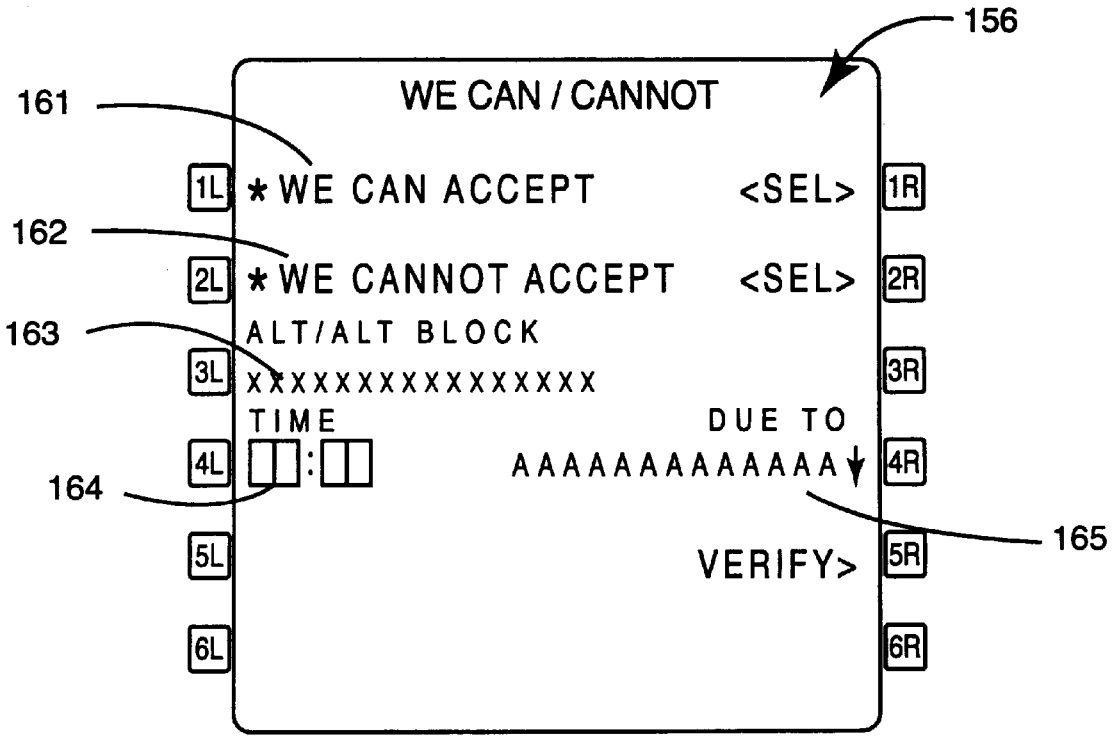
FIG. 16 is a view of an output display according to an aspect of the computer program of FIG. 3.
Figure 17:
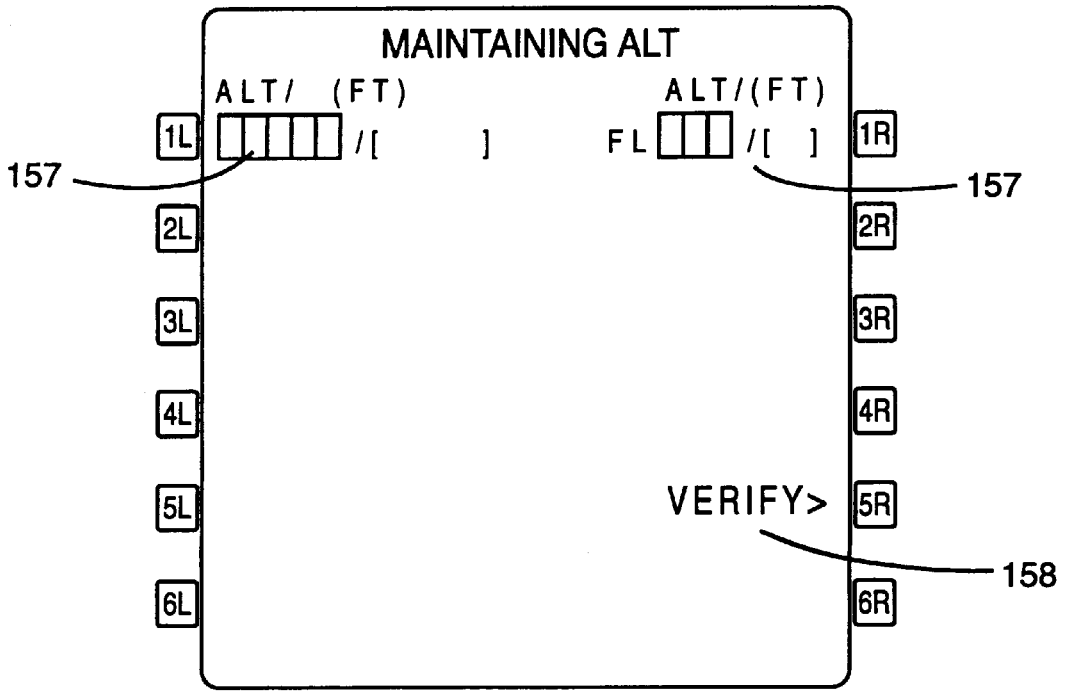
FIG. 17 is a view of an output display according to an aspect of the computer program of FIG. 3.

The program may be designed so that RESPONSE page 150 and REPORTS page 140 are only available if a message has existing responses outstanding. After the messages are answered or responded to, no further reports are available to respond to the message. If an uplinked message requires a specific report to be downlinked, the operator is led to input pages 151–156 designed to gather the required information for the report. Such input pages may be similar in format and subject matter to the input pages 72, 74, 76 and 78 that are displayed in REPORTS/REQUESTS menu 70 and include: ASSIGNED ALT 151, which provides a readback of an assigned altitude; ETA 152, which allows the operator to give notification of estimated time of arrival at the specified position; MAINTAINING ALT 153 (FIG. 17), which gives notification that the aircraft is maintaining an operator-specified altitude; PREFERRED ALT 154, which gives notification of a preferred altitude; TOP OF DESCENT 155, which permits the operator to give notification of a preferred time to commence descent for approach; and WE CAN/CANNOT 156 (FIG. 16), which allows the operator to accept or reject a specified altitude at a specified time. It can be seen that MAINTAINING ALT page 153 (FIG. 17), which is representative of input pages 151–156, contains spaces 157 for data entry as well as an option 158 to display VERIFY page 90 (FIG. 9) once the desired information is entered. Likewise, FIG. 16, which depicts WE CAN/CANNOT page 156, permits the acceptance 161 or the rejection 162 of a ground-supplied altitude request 163 by actuating buttons 1L or 2L, respectively. The operator may also input an acceptance time at 164, or alternately may input a reason for not accepting at 165. Once again, depressing button 5R displays the VERIFY page, which has been previously described.

Figure 18:
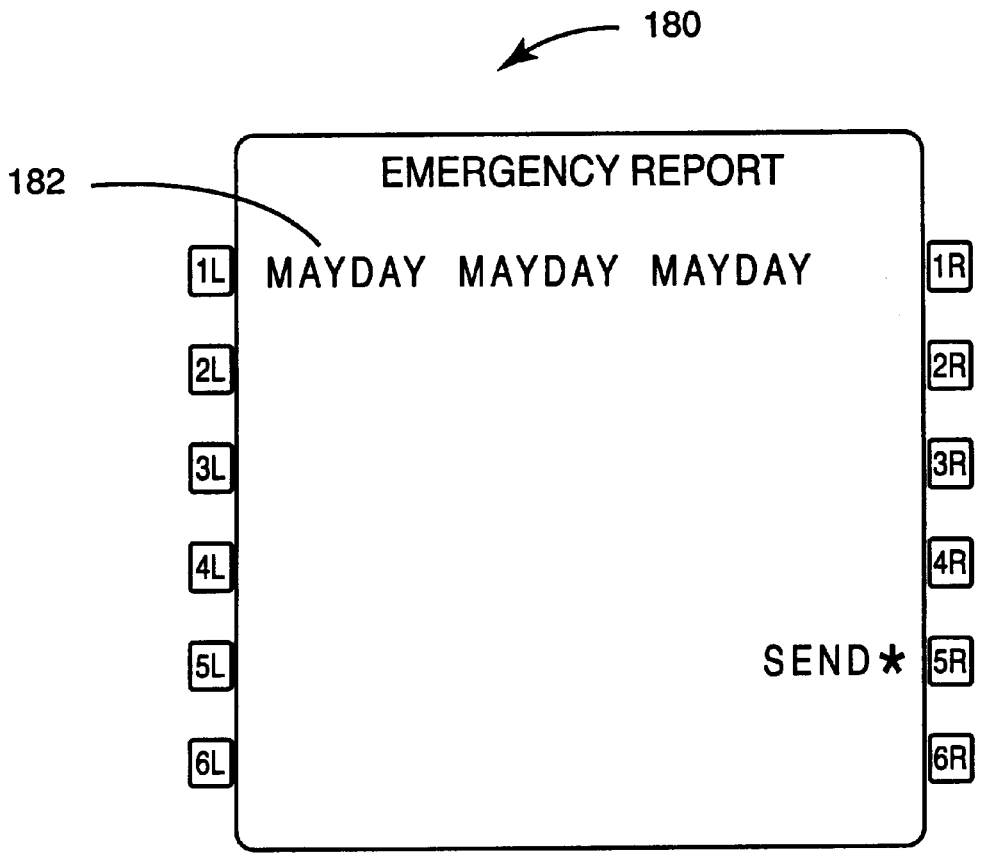
FIG. 18 is a view of an output display according to an aspect of the computer program of FIG. 3.

FIG. 18 depicts EMERGENCY REPORT page 180, upon which is displayed a MAYDAY message 182. Actuating button 5R queues message 182 to be downlinked to a ground control station. MAYDAY message 182 does not require use of VERIFY page 90.

Visual and aural advisories may be included with the program so that a chime (or other sound) and a visual prompt is brought up when an uplink message is received by communications unit 20. Also, communications module 12 may be designed to reject and return messages that do not conform to standard protocol or which may be erroneous. This reduces the workload and frustration of the operator.

One advantage of the invention is that oral communication between a pilot and an ATC center is significantly diminished. This increases air traffic safety.

Another advantage of the invention is that standard air traffic communication protocols are used. This minimizes training time because operators may draw upon their experience to understand how to operate the invention. Furthermore, because a fixed set of messages are used, pilots do not need to be highly proficient in the language used by the ATC center. Misinterpretations or misunderstandings of oral instructions are eliminated.

Another advantage is that security and safety are increased because messages from an ATC center are only delivered to a specific aircraft. This is in contrast to messages being broadcast to everyone listening to the ATC radio frequency.

Another advantage of the invention is that ATC LOG menu 100 lists and prioritizes data uplinks and downlinks so that a pilot is continually made aware of important uplinks from an ATC center. This continuous log ensures that the messages are not forgotten.

Still another advantage of the invention is that MESSAGE REVIEW page 110 is structured so that a message and its response/proposed response are simultaneously displayed. This eliminates a possible extra layer of menu items and simplifies the operation of the invention.

Yet another advantage is that data to be downlinked may be combined into a single transmission to an ATC center, as shown for example in FIG. 8. This further reduces the number of communications to the ATC center and makes controlling air traffic much easier.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims recite "a" include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

I claim:

1. A system for communicating between an aircraft and a ground control station, comprising:

a communications module disposed onboard the aircraft and capable of electronically communicating with the ground control station, wherein the communications module includes an input interface that permits an operator onboard the aircraft to view messages that are sent and received from the ground control station;

wherein the input interface has a plurality of display configurations for the viewing and entry of information, and wherein the input interface permits data relevant to a flight of the aircraft to be entered by the operator while viewing at least one of the plurality of display configurations; and wherein one of the plurality of display configurations has a first section where a message is displayed for viewing by the operator, and a second section where at least one option for responding to the message is displayed, the second section including a display of the operator's response to the message.

2. The system of claim 1, wherein the communications module processes messages from the ground control station that are relevant to the aircraft, and further wherein the communications module ignores messages sent from the ground control station that are not relevant to the aircraft.

3. The system of claim 1, wherein the communications module prevents a message from being sent to the ground control station when required information has not been entered into the input interface.

4. The system of claim 1, wherein the input interface permits speed and at least of altitude information, location and destination data to be entered by the operator within a single display configuration.

5. The system of claim 1, wherein one of the plurality of display configurations is a log of messages that have been sent and received from the ground control station.

6. The system of claim 5, wherein the log of messages is prioritized such that messages requiring response from the operator are displayed prior to messages not requiring response from the operator.

7. The system of claim 5, wherein the log of messages is prioritized in order of urgency of response.

8. The system of claim 5, wherein the log of messages is prioritized such that messages are displayed in the order the messages were processed by the communications module.

9. The system of claim 1, wherein the communications module rejects a message received from the ground control station when required information has not been entered into the input interface.

10. A method for communicating between an aircraft and a ground control station, comprising:

providing a communications module onboard the aircraft, the module electronically communicating with the ground control station, the module including an input interface that permits an operator to interact with the module and communicate with the ground control station;

displaying messages sent and received from the ground control station on a portion of the input interface such that an operator may view the messages upon one of a plurality of display configurations;

processing data relevant to a flight of the aircraft, the data having been entered by the operator while viewing at least one of the display configurations;

displaying a message in a first section of one of the plurality of display configurations; and displaying at least one option for responding to the message in a second section of the display configuration, wherein the operator's response to the message is displayed in the second section.

11. The method of claim 10, further including:

processing messages from the ground control station that are relevant to the aircraft; and ignoring messages sent from the ground control station that are not relevant to the aircraft.

12. The method of claim 10, further including preventing a message from being sent to the ground control station when required information has not been entered into the input interface.

13. The method of claim 10, further permitting speed and at least one of altitude information, location and destination data to be entered by the operator within a single display configuration.

14. The method of claim 10, further including providing a display configuration that lists a log of messages that have been sent and received from the ground control station.

15. The method of claim 14, further including prioritizing the messages listed in the log such that messages requiring response from the operator are displayed prior to messages not requiring response from the operator.

16. The method of claim 14, further including prioritizing the messages in the log based on one or more of urgency of response and the order the messages were processed by the communications module.

* * * * *